US005794511A

United States Patent [19]

Sorbel

[11] Patent Number: 5,794,511

[45] Date of Patent: Aug. 18, 1998

[54] APPARATUS AND METHOD FOR CONTROLLING MULTIPLE FLUID CYLINDERS

[75] Inventor: Dennis L. Sorbel, Maple Park, Ill.

[73] Assignee: Caterpillar Inc., Peoria, Ill.

[21] Appl. No.: 756,622

[22] Filed: Nov. 26, 1996

[51] Int. Cl.[6] ..... F15B 13/06

[52] U.S. Cl. ..... 91/536

[58] Field of Search ..... 91/526, 529, 531, 91/534, 536

[56] References Cited

U.S. PATENT DOCUMENTS

| | | | |
|---|---|---|---|
| 3,304,633 | 2/1967 | Hein et al. | 91/531 |
| 3,512,453 | 5/1970 | Balzer | 91/526 |
| 3,589,242 | 6/1971 | Peterson et al. | 91/531 |
| 3,871,266 | 3/1975 | Schwab et al. | 91/412 |
| 3,921,479 | 11/1975 | Katz | 82/21 |
| 3,966,066 | 6/1976 | Schexnayder | 214/146 |
| 3,979,909 | 9/1976 | Meyer et al. | 60/458 |
| 4,589,076 | 5/1986 | Fujioka | 364/508 |
| 4,704,947 | 11/1987 | Schneider | 91/518 |
| 4,802,537 | 2/1989 | Ryerson | 172/812 |

FOREIGN PATENT DOCUMENTS 1227434 3/1960 France .

OTHER PUBLICATIONS

WO 83/01661 International Application No. PCT/US81/01484 "Lock Valve"—James L. Reeves.

*Primary Examiner*—F. Daniel Lopez

*Attorney, Agent, or Firm*—Maginot, Speroff & Addison; William C. Perry

[57] ABSTRACT

An apparatus for controlling a first fluid cylinder and a second fluid cylinder includes an operational pressure source and a fluid control circuit. The fluid control circuit includes a pilot valve assembly having a first valve position and a second valve position. Moreover, the fluid control circuit (1) delivers pressure from the operational pressure source to the first fluid cylinder when the pilot valve assembly is positioned in the first valve position, (2) isolates the second fluid cylinder from the operational pressure source when the pilot valve assembly is positioned in the first valve position, (3) delivers pressure from the operational pressure source to the second fluid cylinder when the pilot valve assembly is positioned in the second valve position, and (4) isolates the first fluid cylinder from the operational pressure source when the pilot valve assembly is positioned in the second valve position. A method for controlling a first fluid cylinder and a second fluid cylinder is also disclosed.

12 Claims, 2 Drawing Sheets

APPARATUS AND METHOD FOR CONTROLLING MULTIPLE FLUID CYLINDERS

BACKGROUND OF THE INVENTION

The present invention relates generally to fluid circuits, and more particularly to an apparatus and method for controlling multiple fluid cylinders.

Fluid circuits, such as hydraulic circuits, are commonly used on heavy tractors such as excavators and front loaders. Such heavy tractors typically have a boom pivotally attached at a first end thereto. Pivotally attached to a second end of the boom is a beam member. An example of known beam members may include a stick or a telescoping arm. In addition, the beam member has an attachment coupled thereto to perform a number of operations. For example, a stick may have a bucket pivotally coupled thereto in order to perform an excavating operation, or a telescoping arm may have a scraping tool attached thereto for removing slag or other debris from a ladle used in a steel mill's operation.

A number of known cylinders or rams are attached to the boom and beam member in order to move the boom and beam member relative one another and the heavy tractor. In a known manner, fluid pressure is used to extend and retract the cylinders in order to generate the desired movement.

Heavy tractors are equipped with a number of control devices coupled to a plurality of fluid circuits, thereby allowing the operator of the heavy tractor to control the movement of the boom, the beam member, and the attachment. Each of these components, i.e. the boom, the beam member, and the attachment, may require a separate fluid circuit for the control thereof. For example, in the case of an excavator, a first fluid circuit controls the raising and lowering of the boom, a second fluid circuit controls the tilt of the stick, and a third fluid circuit controls the movement of the bucket.

It may be desirable to alternatively control the movement of two components. That is, it may be desirable to prevent the extension or retraction of the cylinder or cylinders that control the movement of one or more components, i.e. the boom, the beam member, or attachment, while the cylinder or cylinders that control the movement of another component are being extended or retracted. For example, in the case of a heavy tractor equipped with a telescoping arm and a scraping tool, the tractor may be rendered unstable if the operator is allowed to simultaneously raise or lower the boom while changing the attitude of, i.e. tilting, the telescoping arm. Therefore, the controls of the tractor must be configured so as to allow the operator to alternatively, as opposed to simultaneously, control the raising or lowering of the boom and the tilting of the telescoping arm.

Moreover, a given heavy tractor may include only a limited number of fluid circuits therein. Therefore, if the heavy tractor is to be fitted with a beam member and attachment assembly that requires more fluid circuits than are present on the tractor, additional fluid circuits must be added. In addition to the cost of the of the additional fluid circuits themselves, additional costs may be incurred if the tractor must be redesigned or otherwise retrofitted to physically accommodate the additional fluid circuits.

What is needed therefore is an apparatus and method for alternatively controlling multiple cylinders with the same fluid circuit.

SUMMARY OF THE INVENTION

In accordance with one embodiment of the present invention there is provided an apparatus for controlling a first fluid cylinder and a second fluid cylinder including an operational pressure source and a fluid control circuit. The fluid control circuit includes a pilot valve assembly having a first valve position and a second valve position. Moreover, the fluid control circuit (1) delivers pressure from the operational pressure source to the first fluid cylinder when the pilot valve assembly is positioned in the first valve position, (2) isolates the second fluid cylinder from the operational pressure source when the pilot valve assembly is positioned in the first valve position, (3) delivers pressure from the operational pressure source to the second fluid cylinder when the pilot valve assembly is positioned in the second valve position, and (4) isolates the first fluid cylinder from the operational pressure source when the pilot valve assembly is positioned in the second valve position.

In accordance with another embodiment of the present invention, there is provided a method for controlling a first fluid cylinder and a second fluid cylinder with a fluid control circuit including an operational pressure source and a pilot valve assembly having a first valve position and a second valve position. The method includes the steps of (1) delivering pressure from the operational pressure source to the first fluid cylinder when the pilot valve assembly is positioned in the first valve position, (2) isolating the second fluid cylinder from the operational pressure source when the pilot valve assembly is positioned in the first valve position, (3) delivering pressure from the operational pressure source to the second fluid cylinder when the pilot valve assembly is positioned in the second valve position, and (4) isolating the first fluid cylinder from the operational pressure source when the pilot valve assembly is positioned in the second valve position.

It is therefore an object of the present invention to provide a new and useful apparatus for controlling a plurality of fluid cylinders.

It is another object of the present invention to provide an improved apparatus for controlling a plurality of fluid cylinders.

It is yet another object the present invention to provide a new and useful method for controlling multiple fluid cylinders.

It is moreover an object of the present invention to provide an improved method for controlling multiple fluid cylinders.

It is further an object of the present invention to provide an apparatus which alternatively controls multiple fluid cylinders from a single main control valve.

It is yet another object of the present invention to provide and apparatus for alternatively controlling multiple fluid cylinders.

It is another object of the present invention to provide an apparatus for controlling multiple fluid cylinders which enhances the stability of a heavy tractor.

The above and other objects, features, and advantages of the present invention will become apparent from the following description and the attached drawings.

DETAILED DESCRIPTION OF THE PREFERRED EMBODIMENT

Figure 1:
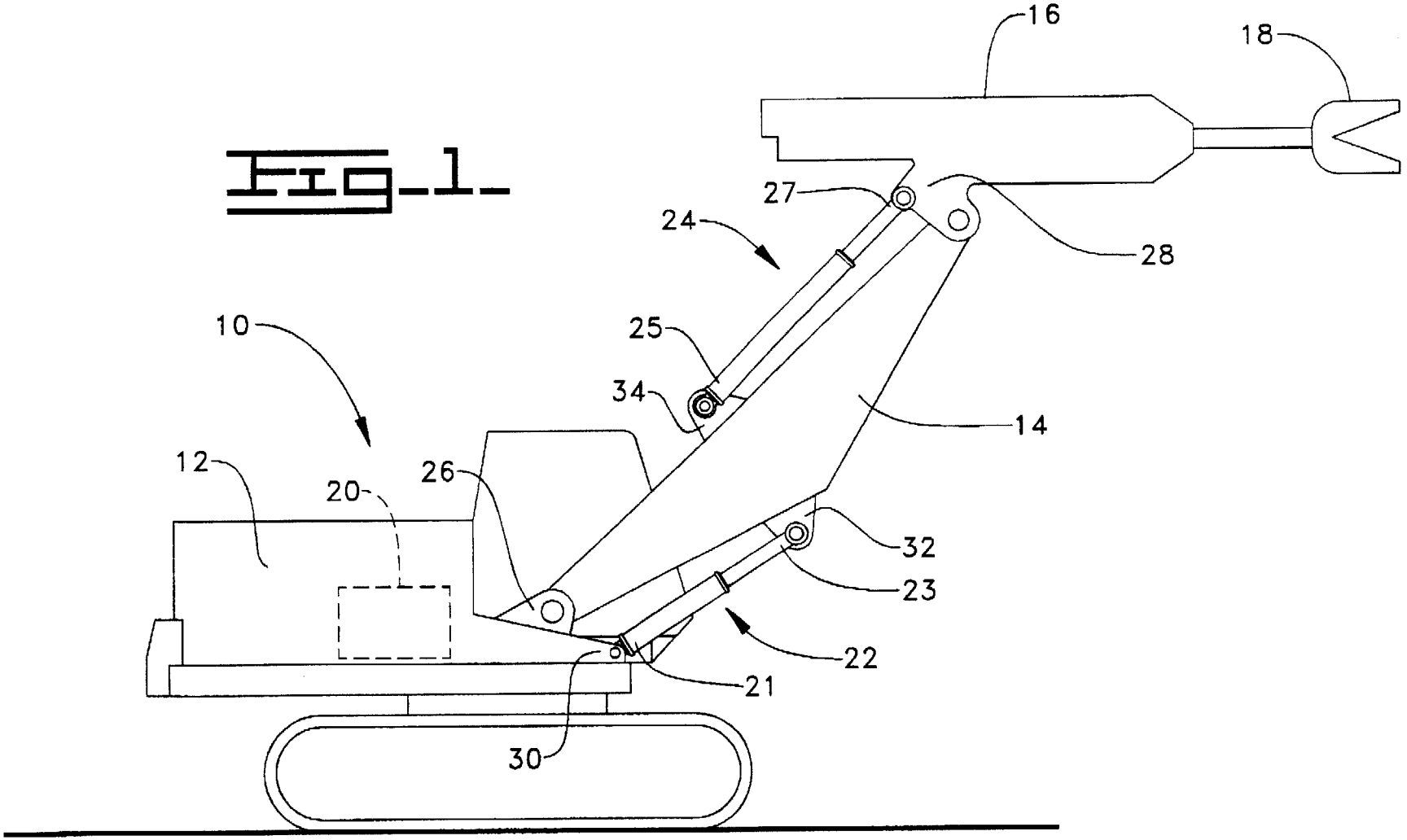
FIG. 1 is a side elevational view of a heavy tractor which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown a heavy tractor 10 which includes a body 12, a boom 14, a telescoping arm 16, a scraping device 18, a fluid control circuit 20, a boom cylinder 22, and a tilt cylinder 24. The body 12 includes a boom brace 26 attached thereto. A first end of the boom 14 is pivotally attached to the boom brace 26, thereby allowing the boom 14 to move relative the body 12. Moreover, the telescoping arm 16 includes a flange 28 attached thereto which is pivotally mounted to a second end of the boom 14, thereby allowing the telescoping arm 16 to move relative the boom 14.

The boom cylinder 22 includes a housing 21 and a rod 23. The housing 21 is pivotally connected to a brace 30 which is coupled to the body 12, whereas the rod 23 is pivotally connected to a brace 32 which is coupled to the boom 14. In a known manner, the rod 23 is urged into or out of the housing 21 upon the application of a fluid pressure in the respective direction thereon. Hence, the boom cylinder 22 provides the motive power for raising or lowering the boom 14. That is, if the boom cylinder 22 is extended, i.e. the rod 23 is urged out of the housing 21, the boom 14 is raised relative to the body 12. Alternatively, if the boom cylinder 22 is retracted, i.e. the rod 23 is urged into the housing 21, the boom 14 is lowered relative to the body 12.

The tilt cylinder 24 includes a housing 25 and a rod 27. The housing 25 is pivotally connected to a brace 34 which is coupled to the boom 14, whereas the rod 27 is pivotally connected to the flange 28 of the telescoping arm 16. In a known manner, the rod 27 is urged into or out of the housing 25 upon the application of a fluid pressure in the respective direction thereon. Hence, the tilt cylinder 24 provides the motive power for altering the attitude, i.e. tilting, of the telescoping arm 16 and hence the scraping device 18. That is, if the tilt cylinder 24 is extended, i.e. the rod 27 is urged out of the housing 25, the telescoping arm 16 is tilted in a downward direction. Alternatively, if the tilt cylinder 24 is retracted, i.e. the rod 27 is urged into the housing 25, the telescoping arm 16 is tilted in an upward direction.

The boom cylinder 22 and the tilt cylinder 24 are controlled by the fluid control circuit 20. In particular, the boom cylinder 22 and the tilt cylinder 24 are extended and/or retracted by a fluid pressure within the fluid control circuit 20. Moreover, the fluid circuit is coupled to a lever 106 (not shown in FIG. 1, but see FIG. 2), thereby allowing an operator of the heavy tractor 10 to control the movement of the boom cylinder 22 and the tilt cylinder 24.

If the boom 14 is raised or lowered simultaneously as the telescoping arm 16 is tilted upwardly or downwardly, the heavy tractor 10 may be rendered unstable, thereby creating a potentially dangerous situation wherein the heavy tractor 10 may tip or overturn. Therefore, the boom cylinder 22 and the tilt cylinder 24 must be alternatively controlled. What is meant herein by the term "alternative control" is that the simultaneous movement of the boom cylinder 22 and the tilt cylinder 24 is prohibited. That is, during the time in which the boom cylinder 22 is being extended or retracted, the tilt cylinder is rendered motionless, and vice versa. As shall be discussed in more detail below, the fluid logic of the fluid control circuit 20 allows for the alternative control of the boom cylinder 22 and the tilt cylinder 24.

Figure 2:
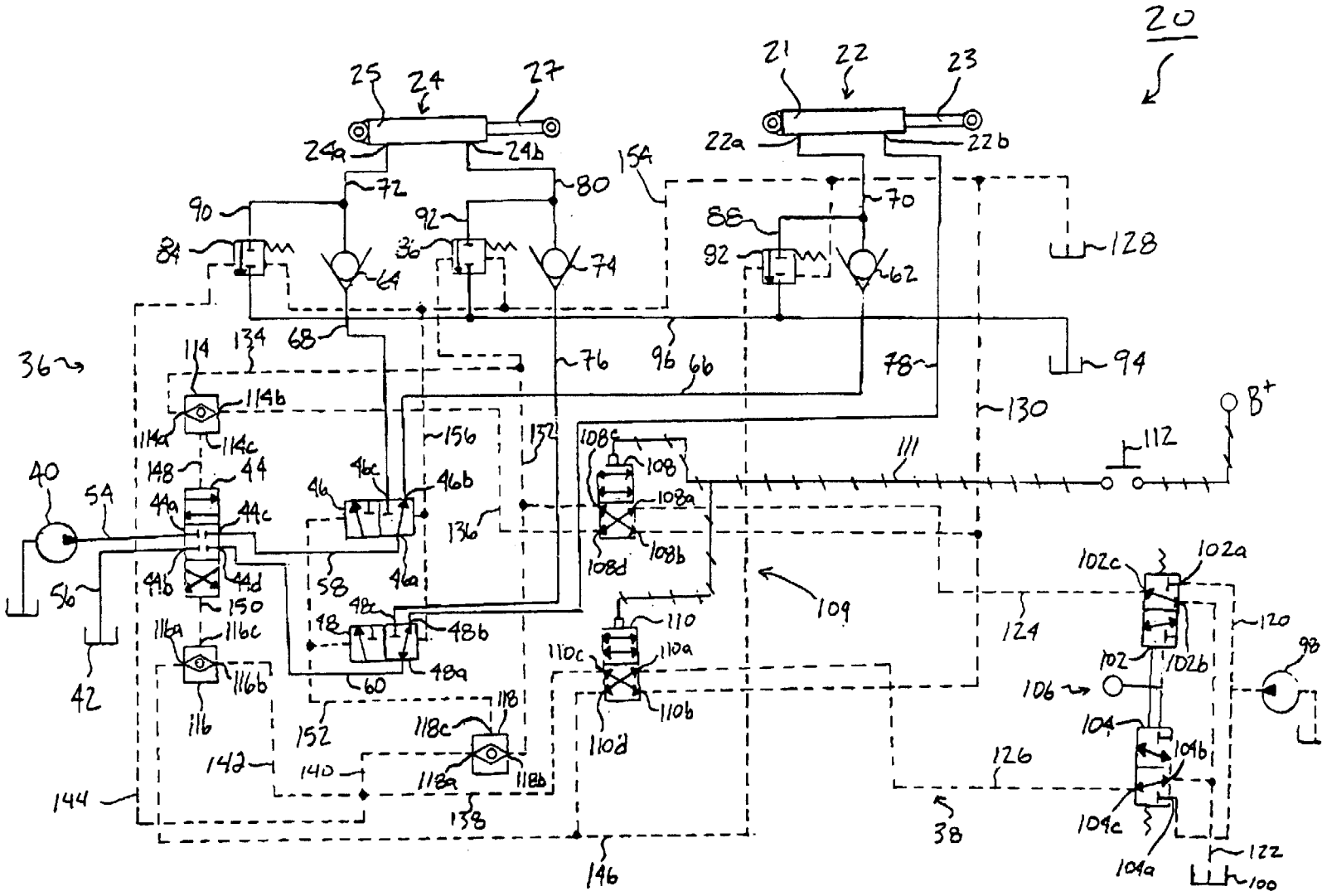
FIG. 2 is a schematic view of a fluid control circuit of the heavy tractor of FIG. 1.

Referring now to FIG. 2, the fluid control circuit 20 of the heavy tractor 10 is shown in fluid communication with the boom cylinder 22 and the tilt cylinder 24. The fluid control circuit 20 includes an operation circuit 36 and a pilot circuit 38. The operation circuit 36 includes a source of pressurized operational fluid such as an operation fluid pump 40, an operation fluid reservoir or drain 42, a main control valve 44, and a pair of diverter valves 46 and 48.

The main control valve 44 is a pilot-controlled three-position, four-way valve with an inlet port **44*a*, an exhaust port 44*b*, a first control port 44*c*, and a second control port 44*d*. Collectively, the control ports 44*c* and 44*d* are commonly referred to as the "stem" of the fluid control circuit 20. An operation fluid, such as oil, is supplied from the operation fluid pump 40 to the inlet port 44*a* via a fluid line 54, whereas operation fluid is transmitted from the exhaust port 44*b* to the operation fluid reservoir 42 via a drain line 56**.

The main control valve 44 transmits operation fluid to the diverter valves 46 and 48. Each of the diverter valves 46 and 48 is a pilot-actuated, two-position valve. The diverter valves 46 and 48 are identical, except that the diverter valve 46 includes an inlet port **46*a*, whereas the diverter valve 48 includes an inlet/outlet port 48*a*. Each of the diverter valves 46 and 48 further includes a first diverter port 46*b* and 48*b*, respectively, and a second diverter port 46*c* and 48*c*, respectively. In particular, the control port 44*c* of the main control valve 44 is coupled to the inlet port 46*a* of the diverter valve 46 via a fluid line 58. Similarly, the control port 44*d* of the main control valve 44 is coupled to the inlet/outlet port 48*a* of the diverter valve 48 via a fluid line 60**.

The diverter valve 46 transmits operation fluid to either a check valve 62 or a check valve 64. More specifically, the diverter port **46*b* is coupled to an inlet of the check valve 62 via a fluid line 66. Moreover, the diverter port 46*c* is coupled to an inlet of the check valve 64 via a fluid line 68. Each of the check valves 62 and 64 is coupled to a head end port 22*a* and 24*a* of the boom cylinder 22 and the tilt cylinder 24, respectively. In particular, an outlet of the check valve 62 is coupled to the head end port 22*a* of the boom cylinder 22 via a fluid line 70, whereas an outlet of the check valve 64 is coupled to the head end port 24*a* of the tilt cylinder 24 via a fluid line 72**.

Similarly, the diverter valve 48 transmits operation fluid to either a rod end port **22*b* of the boom cylinder 22*a* or a check valve 74. That is, the diverter port 48*b* is coupled to the rod end port 22*b* of the boom cylinder 22 via a fluid line 78. Moreover, the diverter port 48*c* is coupled to an inlet of the check valve 74 via a fluid line 76. An outlet of the check valve 74 is coupled to a rod end port 24*b* of the tilt cylinder 24 via a fluid line 80**.

Each of the check valves 62, 64, and 74 may be bypassed by a number of relief valves 82, 84, and 86, respectively. The relief valves 82, 84, and 86 are pilot-actuated, two-way valves with an operation fluid inlet port and an operation fluid outlet port. As shown in FIG. 2, the relief valves 82, 84, and 86 are arranged in parallel flow relationship with the check valves 62, 64, and 74, respectively. More specifically, the inlet ports of each of the relief valves 82, 84, and 86 are respectively coupled to the fluid lines 70, 72, and 80 by a number of bypass fluid lines 88, 90, and 92, respectively. Moreover, the outlet ports of each of the relief valves 82, 84, and 86 are coupled to an operation fluid reservoir or drain 94 via a drain line 96.

In order to control the position of the various valves within the operation circuit 36, i.e. the main control valve 44, the diverter valves 46 and 48, and the relief valves 82, 84, and 86, the fluid control circuit 20 includes the pilot circuit 38. The pilot circuit 38 includes a pilot fluid pump 98, a pilot fluid reservoir or drain 100, a pair of directional valves 102 and 104 coupled to a lever 106, a pilot valve assembly 109, and a number of ball resolvers 114, 116, and 118. Moreover, the pilot valve assembly 109 includes a pair of electrically actuated pilot valve units 108 and 110 which are electrically coupled a voltage potential B+ via an electrical signal line 111 with a normally-open switch 112 therein.

Each of the directional valves 102 and 104 is an operator-controlled, two-position, three-way valve which respectively includes an inlet port 102*a* and 104*a*, an exhaust port 102*b* and 104*b*, and a directional port 102*c* and 104*c*. A pressurized pilot fluid, such as oil, is supplied from the pilot fluid pump 98 to the inlet ports 102*a* and 104*a* via a pilot line 120, whereas pilot fluid is transmitted from the exhaust ports 102*b* and 104*b* to the pilot fluid reservoir 100 via a pilot drain line 122.

The directional valves 102 and 104 direct pilot fluid to the pilot valve assembly 109. More specifically, the directional valve 102 is coupled to the pilot valve unit 108, whereas the directional valve 104 is coupled to the pilot valve unit 110. Each of the pilot valve units 108 and 110 is an electrically-actuated, two-position, four-way valve which respectively includes an inlet port 108*a* and 110*a*, an outlet port 108*b* and 110*b*, a first pilot port 108*c* and 110*c*, and a second pilot port 108*d* and 110*d*. In particular, the directional port 102*c* of the directional valve 102 is coupled to the inlet port 108*a* of the pilot valve unit 108 via a pilot line 124. Similarly, the directional port 104*c* of the directional valve 104 is coupled to the inlet port 110*a* of the pilot valve unit 110 via a pilot line 126. Moreover, the exhaust ports 108*b* and 110*b* are coupled to a pilot reservoir or drain 128 via a pilot drain line 130.

The pilot port 108*c* of the pilot valve unit 108 is coupled to a pilot line 132, which is in turn coupled to (1) a port 114*a* of the ball resolver 114 via a pilot line 134, (2) a pilot inlet of the relief valve 86, and (3) a port 118*b* of the ball resolver 118. Moreover, the pilot port 108*d* is coupled to a port 114*b* of the ball resolver 114 via a pilot line 136.

Similarly, the pilot port 110*c* of the pilot valve unit 110 is coupled to a pilot line 138, which is in turn coupled to (1) a port 118*a* of the ball resolver 118 via a pilot line 140, (2) a port 116*b* of the ball resolver 116 via a pilot line 142, and (3) a pilot inlet of the relief valve 84 via a pilot line 144. Moreover, the pilot port 110*d* of the pilot valve unit 110 is coupled to a port 116*a* of the ball resolver 116 and a pilot inlet of the relief valve 82 via a pilot line 146.

A pair of actuation ports 114*c* and 116*c* of the ball resolvers 114 and 116, respectively, are coupled to the main control valve 44 by a pair of pilot lines 148 and 150, respectively, as shown in FIG. 2. Moreover, an actuation port 118*c* of the ball resolver 118 is coupled to a pilot inlet port of the diverter valves 46 and 48 via a pilot line 152.

Each of the relief valves 82, 84, and 86 includes a pilot outlet port which is coupled to the pilot reservoir 128 via a pilot drain line 154. Similarly, a pilot outlet port included on each of the diverter valves 46 and 48 is coupled to the pilot drain line 154, and hence the pilot reservoir 128, via a pilot drain line 156.

In order to raise the boom 14 (see FIG. 1), i.e. extend the boom cylinder 22, the lever 106 is moved upwardly (relative to the view in the fluid schematic of FIG. 2) such that the directional valve 102 is moved from a neutral position (as shown) to an active position, thereby placing the directional port 102*c* in fluid communication with the pilot line 120 and hence the fluid pump 98. After which, pilot fluid is directed to the inlet port 108*a* of the pilot valve unit 108 via the pilot line 124. When isolated from the voltage potential B+, the pilot valve assembly 109 remains in a first valve position. More specifically, the pilot valve unit 108 remains in a first pilot position (as shown) as long as the switch 112 is in an open or first switch position (as shown). Hence, pilot fluid entering the inlet port 108*a* is exited through the pilot port 108*d*.

Thereafter, pilot fluid is advanced via the pilot line 136 to the port 114*b* of the ball resolver 114 which transmits an actuation signal on the pilot line 148. The actuation signal on the pilot line 148 causes the main control valve 44 to be shifted downwardly (relative to the view in the fluid schematic of FIG. 2) from a neutral or fluid obstructing position (as shown) to a first fluid transmitting position.

Once the main control valve 44 is switched from the neutral or fluid obstructing position, pressurized operation fluid is directed from the operation fluid pump 40 to the inlet port 44*a* of the main control valve 44 via fluid line 54. Since the main control valve 44 is in a first fluid transmitting position, operation fluid is exited therefrom via the control port 44*c*. Thereafter, operation fluid is advanced via the fluid line 58 to the inlet port 46*a* of the diverter valve 46.

Since the diverter valve 46 is in a first or boom-control position (as shown), operation fluid is exited therefrom via the diverter port 46*b*. Operation fluid is then advanced to the head end port 22*a* of the boom cylinder 22 via a fluid path which includes the fluid line 66, the check valve 62, and the fluid line 70, thereby urging or extending the rod 23 out of the housing 21.

Operation fluid is exhausted from the rod end port 22*b* of the boom cylinder 22 via the fluid line 78. Exhausted operation fluid is advanced through the fluid line 78 to the diverter port 48*b* of the diverter valve 48. Since the diverter valve 48 is in a first or boom-control position (as shown), exhausted operation fluid is advanced into the diverter port 48*b* and exited through the inlet/outlet port 48*a*. After which, exhausted operation fluid is advanced to the operation fluid reservoir 42 via a fluid path which includes the fluid line 60, the main control valve 44, and the drain line 56.

In order to lower the boom 14 (see FIG. 1), i.e. retract the boom cylinder 22, the lever 106 is moved downwardly (relative to the view in the fluid schematic of FIG. 2) such that the directional valve 104 is moved from a neutral position (as shown) to an active position, thereby placing the directional port 104*c* in fluid communication with the pilot line 120 and hence the fluid pump 98. After which, pilot fluid is directed to the inlet port 110*a* of the pilot valve unit 110 via the pilot line 126. When isolated from the voltage potential B+, the pilot valve assembly 109 remains in the first valve position. More specifically, the pilot valve unit 110 remains in a third pilot position (as shown) as long as the switch 112 is in an open or first switch position (as shown). Hence, pilot fluid entering the inlet port 110*a* is exited through the pilot port 110*d*.

Thereafter, pilot fluid is advanced via pilot line 146 to the port 116*a* of the ball resolver 116 which transmits an actuation signal on the pilot line 150. The actuation signal on the pilot line 150 causes the main control valve 44 to be shifted upwardly (relative to the view in the fluid schematic of FIG. 2) from a neutral or fluid obstructing position (as shown) to a second fluid transmitting position. Simultaneously, pilot fluid is advanced via the pilot line 146 to the pilot inlet of the relief valve 82 causing the relief valve 82 to be switched from a first or fluid obstructing position (as shown) to a second or fluid transmitting position.

Once the main control valve 44 is switched from the neutral or fluid obstructing position, pressurized operation fluid is directed from the operation fluid pump 40 to the inlet port 44*a* of the main control valve 44 via the fluid line 54. Since the main control valve 44 is in a second fluid transmitting position, operation fluid is exited therefrom via the control port 44*d*. Thereafter, operation fluid is advanced via the fluid line 60 to the inlet/outlet port 48*a* of the diverter valve 48.

Since the diverter valve 48 is in the first or boom-control position (as shown), operation fluid is exited therefrom via diverter port 48*b*. Operation fluid is then advanced to the rod end port 22*b* of the boom cylinder 22 via the fluid line 78, thereby urging or retracting the rod 23 into the housing 21.

Operation fluid is exhausted from the head end port 22*a* of the boom cylinder 22 via the fluid line 70. Exhausted operation fluid is not permitted to advance from the outlet to the inlet of the check valve 62, but rather is advanced to the operation fluid reservoir 94 via a fluid path which includes the fluid line 88, the relief valve 82, and the drain line 96. Note that the pilot signal which actuates the relief valve 82 is exhausted to the pilot reservoir 128 via the pilot drain line 154.

In order to tilt the telescoping arm 16 (see FIG. 1) downwardly, i.e. extend the tilt cylinder 24, the switch 112 is depressed, thereby positioning the switch 112 in a closed or second switch position, and the lever 106 is moved upwardly (relative to the view in the fluid schematic of FIG. 2). Hence, the pilot valve assembly 109 is placed in electrical contact with the voltage potential B+ and is therefore moved from the first valve position (as shown) to a second valve position. More specifically, the pilot valve unit 108 is moved from the first pilot position (as shown) to a second pilot position. Moreover, the upward movement of the lever 106 causes the directional valve 102 to be moved from the neutral position (as shown) to the active position, thereby placing the directional port 102*c* in fluid communication with the pilot line 120 and hence the pilot fluid pump 98. After which, pilot fluid is directed to the inlet port 108*a* of the pilot valve unit 108 via the pilot line 124. Since the pilot valve unit 108 is in the second pilot position, pilot fluid entering the inlet port 108*a* is exited through the pilot port 108*c*.

Thereafter, pilot fluid is advanced via pilot line 132 to (1) the port 114*a* of the ball resolver 114 via pilot line 134 which in turn transmits an actuation signal on the pilot line 148, (2) the port 118*b* of the ball resolver 118 which in turn transmits an actuation signal on the pilot line 152, and (3) the pilot inlet port of the relief valve 86 which causes the relief valve 86 to change from a first or fluid obstruction position to a second or fluid transmitting position. The actuation signal on the pilot line 148 causes the main control valve 44 to be shifted downwardly (relative to the view in the fluid schematic of FIG. 2) from the neutral or fluid obstructing position (as shown) to the first fluid transmitting position. Moreover, the actuation signal on the pilot line 152 causes the diverter valve 46 to change from the first or boom-control position (as shown) to a second or tilt-control position.

Once the main control valve 44 is switched from the neutral or fluid obstructing position, pressurized operation fluid is directed from the operation fluid pump 40 to the inlet port 44*a* of the main control valve 44 via the fluid line 54. Since the main control valve 44 is in the first fluid transmitting position, operation fluid is exited therefrom via the control port 44*c*. Thereafter, operation fluid is advanced via the fluid line 58 to the inlet port 46*a* of the diverter valve 46.

Since the diverter valve 46 is in the second or tilt-control position, operation fluid is exited therefrom via diverter port 46*c*. Operation fluid is then advanced to the head end port 24*a* of the tilt cylinder 24 via a fluid path which includes the fluid line 68, the check valve 64, and the fluid line 72, thereby urging or extending the rod 27 out of the housing 25.

Operation fluid is exhausted from the rod end port 24*b* of the tilt cylinder 24 via the fluid line 80. The exhausted operation fluid is not permitted to advance from the outlet to the inlet of the check valve 74, but rather is advanced to the operation fluid reservoir 94 via a fluid path which includes the fluid line 92, the relief valve 86, and the drain line 96. Note that the pilot signal which actuates the relief valve 86 is exhausted to the pilot reservoir 128 via the pilot drain line 154. Moreover, the pilot signal which actuates the directional valve 46 is exhausted to the pilot drain line 154 and hence the pilot reservoir 128 via the pilot drain line 156.

In order to tilt the telescoping arm 16 (see FIG. 1) upwardly, i.e. retract the tilt cylinder 24, the switch 112 is depressed, thereby positioning the switch 112 in the closed or second switch position, and the lever 106 is moved downwardly (relative to the view in the fluid schematic of FIG. 2). Hence, the pilot valve assembly 109 is placed in electrical contact with the voltage potential B+ and is therefore moved from the first valve position (as shown) to the second valve position. More specifically, the pilot valve unit 110 is moved from the third pilot position (as shown) to a fourth pilot position. Moreover, the downward movement of the lever 106 causes the directional valve 104 to be moved from the neutral position (as shown) to the active position, thereby placing the directional port 104*c* in fluid communication with the fluid line 120 and hence the pilot fluid pump 98. After which, pilot fluid is directed to the inlet port 110*a* of the pilot valve unit 110 via pilot line 126. Since the pilot valve unit 110 is in the fourth pilot position, pilot fluid entering the inlet port 110*a* is exited through the pilot port 110*c*.

Thereafter, pilot fluid is advanced via pilot line 138 to (1) the port 116*b* of the ball resolver 116 via pilot line 142 which in turn transmits an actuation signal on the pilot line 150, (2) the port 118*a* of the ball resolver 118 which in turn transmits an actuation signal on the pilot line 152, and (3) the pilot inlet port of the relief valve 84 via the pilot line 144 which causes the relief valve 84 to change from a first or fluid obstruction position to a second or fluid transmitting position. The actuation signal on the pilot line 150 causes the main control valve 44 to be shifted upwardly (relative to the view in the fluid schematic of FIG. 2) from the neutral or fluid obstructing position (as shown) to the second fluid transmitting position. Moreover, the actuation signal on the pilot line 152 causes the diverter valve 48 to change from the first or boom-control position (as shown) to a second or tilt-control position.

Once the main control valve 44 is switched from the neutral or fluid obstructing position, pressurized operation fluid is directed from the operation fluid pump 40 to the inlet port 44*a* of the main control valve 44 via the fluid line 54. Since the main control valve 44 is in the second fluid transmitting position, operation fluid is exited therefrom via the control port 44*d*. Thereafter, operation fluid is advanced via the fluid line 60 to the inlet/outlet port 48*a* of the diverter valve 48.

Since the diverter valve 48 is in the second or tilt-control position, operation fluid is exited therefrom via diverter port 48*c*. Operation fluid is then advanced to the rod end port 24*b* of the tilt cylinder 24 via a fluid path which includes the fluid line 76, the check valve 74, and the fluid line 80, thereby urging or retracting the rod 27 into the housing 25.

Operation fluid is exhausted from the head end port 24*a* of the tilt cylinder 24 via the fluid line 72. Exhausted operation fluid is not permitted to advance from the outlet to the inlet of the check valve 64, but rather is advanced to the operation fluid reservoir 94 via a fluid path which includes the fluid line 90, the relief valve 84, and the drain line 96. Note that the pilot signal which actuates the relief valve 84 is exhausted to the pilot reservoir 128 via the pilot drain line 154. Moreover, the pilot signal which actuates the directional valve 48 is exhausted to the pilot drain line 154 and hence the pilot reservoir 128 via the pilot drain line 156.

From the above discussion, it should be appreciated that the control of the boom cylinder 22 is isolated from the control of tilt cylinder 24. That is, the position, i.e. open or closed, of the switch 112 and hence the position of the pilot valve units 108 and 110, i.e. the boom-control position or the tilt-control position, determines whether the lever 106 controls the movement, i.e. extension or retraction, of either the boom cylinder 22 or the tilt cylinder 24. Therefore, it should be appreciated that the lever 106 may not move, i.e. extend or retract, the boom cylinder 22 and the tilt cylinder 24 simultaneously. Hence, the boom cylinder 22 and the tilt cylinder 24 may be alternatively controlled by the same set of controls, i.e. the lever 106 and the switch 112.

Moreover, it should be further appreciated that the boom cylinder 22 and the tilt cylinder 24 are both controlled from the same stem. That is, the same control ports 44*c* and 44*d* of the main control valve 44 may be used to control the movement, i.e. the extension and contraction, of both the boom cylinder 22 and the tilt cylinder 24.

While the invention has been illustrated and described in detail in the drawings and foregoing description, such an illustration and description is to be considered as exemplary and not restrictive in character, it being understood that only the preferred embodiment has been shown and described and that all changes and modifications that come within the spirit of the invention are desired to be protected.

For example, although the fluid control circuit 20 in FIG. 2 is shown having a separate operation fluid pump 40 and pilot fluid pump 98, it should be appreciated that a single operational pressure source, i.e. a single pump, may be used to supply the fluid pressure for both the operation circuit 36 and the pilot circuit 38.

Moreover, the magnitude of the voltage potential B+ in the demonstrated embodiment of FIG. 2 is +24 VDC. However, it should be appreciated that the magnitude of the voltage potential may be altered to any value which may be readily available in the electrical system of a given heavy tractor 10, so long as the value of the voltage potential selected can actuate the pilot valve units 108 and 110.

In addition, although the lever 106 and switch 112 are shown as separate, discrete devices in FIG. 2, it should be appreciated that the two may be integrated. More specifically, the switch 112 may be integrated into a handle of the lever 106, thereby allowing the operator of the heavy tractor 10 to operate the lever 106 and the switch 112 with the same hand.

Further, although the boom cylinder 22 and the tilt cylinder 24 are each described as a single cylinder, it should be appreciated that the boom cylinder 22 or the tilt cylinder 24 may be a plurality, e.g. a pair, of boom cylinders 22 or tilt cylinders 24, respectively, working in unison.

What is claimed is:

1. An apparatus for controlling a first fluid cylinder and a second fluid cylinder, comprising:

an operational pressure source;

a main control valve having a first fluid transmitting position and a second fluid transmitting position, first and second diverter valves adapted for fluid communication between the main control valve and the first and second fluid cylinders, said diverter valves being selectively operable between a first position wherein fluid communication is established with the first fluid cylinder and isolated from the second fluid cylinder and a second position wherein fluid communication is established with the second fluid cylinder and isolated from the first fluid cylinder, said first and second cylinders being operable in a first direction when the main control valve is in its first fluid transmitting position and a second direction when the main control valve is in the second fluid transmitting position, a pilot pressure source, a fluid control circuit including first and second directional valves, each being selectively operable between a first neutral position and a second active position wherein the pilot pressure source is communicated to the main control valve to selectively position the main control valve in one of its first and second fluid transmitting positions;

a pilot valve assembly having a first valve position and a second valve position and being adapted for communication of pilot pressure with the first and second diverter valves to selectively control the movement thereof between their first and second positions; and at least one ball resolver positioned in communication with the pilot pressure source and the main control valve, said ball resolver being placed in communication with the pilot pressure source upon the positioning of the directional valve in said first active position and said main control valve being positioned in said first fluid transmitting position when said first ball resolver is placed in fluid communication with said pilot pressure source.

2. The apparatus of claim 1, wherein said fluid control circuit further includes a second ball resolver which is in fluid communication with said main control valve, said second ball resolver is placed in fluid communication with said pilot pressure source when said second directional valve is positioned in said second active position, said main control valve is positioned in said second fluid transmitting position when said second ball resolver is placed in fluid communication with said pilot pressure source.

3. The apparatus of claim 1, wherein said fluid control circuit further includes a lever for (1) moving said first directional valve between said first neutral position and said first active position, and (2) moving said second directional valve between said second neutral position and said second active position.

4. The apparatus of claim 1 wherein:

said first diverter valve has a first boom-control position and a first tilt-control position, said first fluid cylinder includes a first head end and a first rod end, said second fluid cylinder includes a second head end and a second rod end, operational pressure is transmitted through said first diverter valve to said first head end of said first fluid cylinder when said first diverter valve is positioned in said first boom-control position, and operational pressure is transmitted through said first diverter valve to said second head end of said second fluid cylinder when said first diverter valve is positioned in said first tit-control position.

5. The apparatus of claim 4, wherein:

said second diverter valve has a second boom-control position and a second tilt-control position, operational pressure is transmitted through said second diverter valve to said first rod end of said first fluid cylinder when said second diverter valve is positioned in said second boom-control position, and operational pressure is transmitted through said second diverter valve to said second rod end of said second fluid cylinder when said second diverter valve is positioned in said second tilt-control position.

6. The apparatus of claim 5, wherein:

said fluid control circuit further includes a pilot pressure source, and said pilot valve assembly further includes (1) a first pilot valve unit in fluid communication with said pilot pressure source, and (2) a second pilot valve unit in fluid communication with said pilot pressure source.

7. The apparatus of claim 6, wherein:

said first pilot valve unit has a first pilot position and a second pilot position, and said first diverter valve is placed in fluid communication with said pilot pressure source so that said first diverter valve assumes said first tilt-control position when said first pilot valve unit is positioned in said second pilot position.

8. The apparatus of claim 7, wherein:

said first diverter valve is isolated from fluid communication with said pilot pressure source so that said first diverter valve assumes said first boom-control position when said first pilot valve unit is positioned in said first pilot position.

9. The apparatus of claim 8, wherein:

said second pilot valve unit has a third pilot position and a fourth pilot position, and said second diverter valve is placed in fluid communication with said pilot pressure source so that said second diverter valve assumes said second tilt-control position when said second pilot valve unit is positioned in said fourth pilot position.

10. The apparatus of claim 9, wherein:

said second diverter valve is isolated from fluid communication with said pilot pressure source so that said second diverter valve assumes said second boom-control position when said second pilot valve unit is positioned in said third pilot position.

11. The apparatus of claim 10, wherein said fluid control circuit further includes:

a voltage source; and a switch for (1) isolating said first pilot valve assembly from said voltage source when said switch is located at a first switch position, and (2) coupling said voltage source to said pilot valve assembly when said switch is located at a second switch position.

12. The apparatus of claim 11, wherein:

said first pilot valve unit is positioned in said first pilot position when said switch is positioned in said first switch position, said first pilot valve unit is positioned in said second pilot position when said switch is positioned in said second switch position, said second pilot valve unit is positioned in said third pilot position when said switch is positioned in said first switch position, and said second pilot valve unit is positioned in said fourth pilot position when said switch is positioned in said second switch position.

* * * * *